US006357309B1

(12) United States Patent
Maruhashi

(10) Patent No.: US 6,357,309 B1
(45) Date of Patent: Mar. 19, 2002

(54) STARTER

(75) Inventor: Yasuhiko Maruhashi, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/645,489

(22) Filed: Aug. 25, 2000

(30) Foreign Application Priority Data

Aug. 27, 1999 (JP) ..... 11-240909

(51) Int. Cl.[7] ..... F02N 19/34
(52) U.S. Cl. ..... 74/6; 290/38 R; 411/539
(58) Field of Search ..... 74/6; 384/420, 384/425, 903; 411/539, 522

(56) References Cited

U.S. PATENT DOCUMENTS 4,304,140 A * 12/1981 Ebihara ..... 74/7 R
5,014,563 A * 5/1991 Isozumi ..... 74/7 R
5,045,737 A * 9/1991 Yamauchi ..... 310/89
6,006,618 A * 12/1999 Yumiyama ..... 74/7 A

FOREIGN PATENT DOCUMENTS

JP 7-30631 * 11/1995

* cited by examiner

*Primary Examiner*—David A. Bucci
*Assistant Examiner*—Timothy McAnulty
(74) *Attorney, Agent, or Firm*—Crowell & Moring LLP

(57) ABSTRACT

The present invention relates to reduce noises when a starter is put in motion with a simple modification to its structure without increasing the number of parts.

A circumferential groove is made in a portion near one end of the shaft of an armature and the holder plate of a brush is fixed to the inside of the end surface of the bracket with screws, and the outer peripheral portion of the washer is sandwiched by the bracket and the holder plate and the inner peripheral portion of the washer is fitted in the circumferential groove of the shaft to limit the movement of the armature. Letting the pitch of the screws for fixing the holder plate to the bracket=L, the outer diameter of the washer=D1, the outer diameter of the screw=D2, the thickness of the holder plate=t, and a distance between the center of the armature and the screw=R, they satisfy the following Formula 13 and Formula 14, $$D1+D2<L\leqq D1+D2+5t \quad \text{(Formula 13)}$$

$$(D1+D2)/2<R\leqq(D1+D2+5t)/2 \quad \text{(Formula 14)}$$

4 Claims, 4 Drawing Sheets

STARTER

BACKGROUND OF THE INVENTION

1. Field of the Invention

The present invention relates to a starter of an internal combustion engine of an automobile or the like and, in particular, to a structure for mounting a washer for regulating the movable distance of an armature in the direction of thrust.

2. Description of the Related Art

As a publicly known technology relating to a starter, a technology is disclosed in Japanese Unexamined Patent Publication No. 7-310631. In this starter, the shaft of a revolving armature supported by a bracket via a bearing has a groove made in a circumferential direction (hereinafter sometimes referred to as a circumferential groove) near its one end and a holder plate for holding a brush is fixed to the inside of the end surface of the bracket with screws and the outer peripheral portion of a washer is sandwiched by the bracket and the holder plate and the inner peripheral portion of the washer is fitted in the circumferential groove to regulate the movable distance of the armature in the direction of thrust (in the axial direction). The movable distance is a gap in the axial direction between the washer and the circumferential groove and is set within a given range (for example, 0.2 mm or less) based on the relationship between the width of the circumferential groove and the thickness of the washer.

The above-mentioned publicly known technology limits the movable distance of the armature in the direction of thrust within a given range and does not disclose adequate findings on the relationship between the rigidity of the washer holding the armature and vibration noises generated when the washer receives a thrust load.

In the case where a great deal of thought is not given to the rigidity of the washer holding the armature, large vibrations in the direction of thrust are produced during the rotation of the armature to vibrate the bracket, which might in turn make the bracket itself produce resonance. Therefore, it is required to provide a technology to reduce these vibrations and noises.

SUMMARY OF THE INVENTION

It is the object of the present invention to provide a starter capable of reducing noises when the starter is put in motion with a simple modification to its structure without increasing the number of parts.

The present inventor has well studied the publicly known technology and has found that the positions of screws for fixing a holder plate pressing a washer for regulating the movement of an armature in the direction of thrust greatly relates to the vibrations and noises generated when the starter is put in motion and hence constitutes the present invention basically in such a way as is described in the following, so as to accomplish the above-mentioned object.

(1) According to the first invention, there is provided a starter comprising an armature provided with a shaft having a groove made in a circumferential direction near its one end, a bracket provided with a bearing rotatably supporting the one end of the shaft, a holder plate for holding the brush of a motor, screws for fixing the holder plate to the inside of the end surface of the bracket, and a washer having an inner peripheral portion fitted in the groove made in the circumferential direction of the shaft and an outer peripheral portion sandwiched between the bracket and the holder plate, the washer limiting the movement of the armature in the axial direction, wherein, letting the pitch of the screws=L when the screws for fixing the holder plate to the bracket are spaced 180 degrees apart, the outer diameter of the washer=D1, the outer diameter of the screw=D2, and the thickness of the holder plate=t, they satisfy the following Formula 5, $$D1+D2<L\leqq D1+D2+5t \quad \text{(Formula 5)}$$

(2) According to the second invention, there is provided a starter in which the condition of the pitch L is relaxed as compared with the first invention, wherein, letting the pitch of the screws=L when the screws for fixing the holder plate to the bracket are spaced 180 degrees apart, as is the case with the first invention, the outer diameter of the washer=D1, the outer diameter of the screw=D2, and the thickness of the holder plate=t, they satisfy the following Formula 6, $$D1+D2<L\leqq D1+D2+10t \quad \text{(Formula 6)}$$

In the first and second inventions, the present invention is defined by the pitch L of the screws for fixing the holder plate which are spaced 180 degrees apart. However, the number of the screws is not limited to two but may be more than two and the spacing of the screws may be different from the 180 degrees. In this case, the following invention will be proposed so as to accomplish the above-mentioned object.

(3) According to the third invention, there is provided a starter in which, letting the distance between the center of the shaft of the armature and the center of the screws=R, the outer diameter of the washer=D1, the outer diameter of the screw=D2, and the thickness of the holder plate=t, they satisfy the following Formula 7, $$(D1+D2)/2<R\leqq(D1+D2+5t)/2 \quad \text{(Formula 7)}$$

The above-mentioned Formula 7 (Formula 3) is equivalent to the Formula 5 (Formula 1).

(4) According to the fourth invention, there is provided a starter in which the condition of the third invention is relaxed, that is, letting the distance between the center of the shaft of the armature and the center of the screws=R, the outer diameter of the washer=D1, the outer diameter of the screw=D2, and the thickness of the holder plate=t, they satisfy the following Formula 8, $$(D1+D2)/2<R\leqq(D1+D2)/2+5t \quad \text{(Formula 8)}$$

In this connection, the above-mentioned Formula 8 (Formula 4) is equivalent to the Formula 6 (Formula 2).

The detailed description of the present invention, in particular, the reason of the Formulae will be described in detail in the following preferred embodiment.

BRIEF DESCRIPTION OF THE DRAWINGS

Preferred embodiments of the present invention will be described in detail based on the following figures, in which.

DESCRIPTION OF THE PREFERRED EMBODIMENT

The preferred embodiment in accordance with the present invention will be described based on the drawings.

Figure 1:
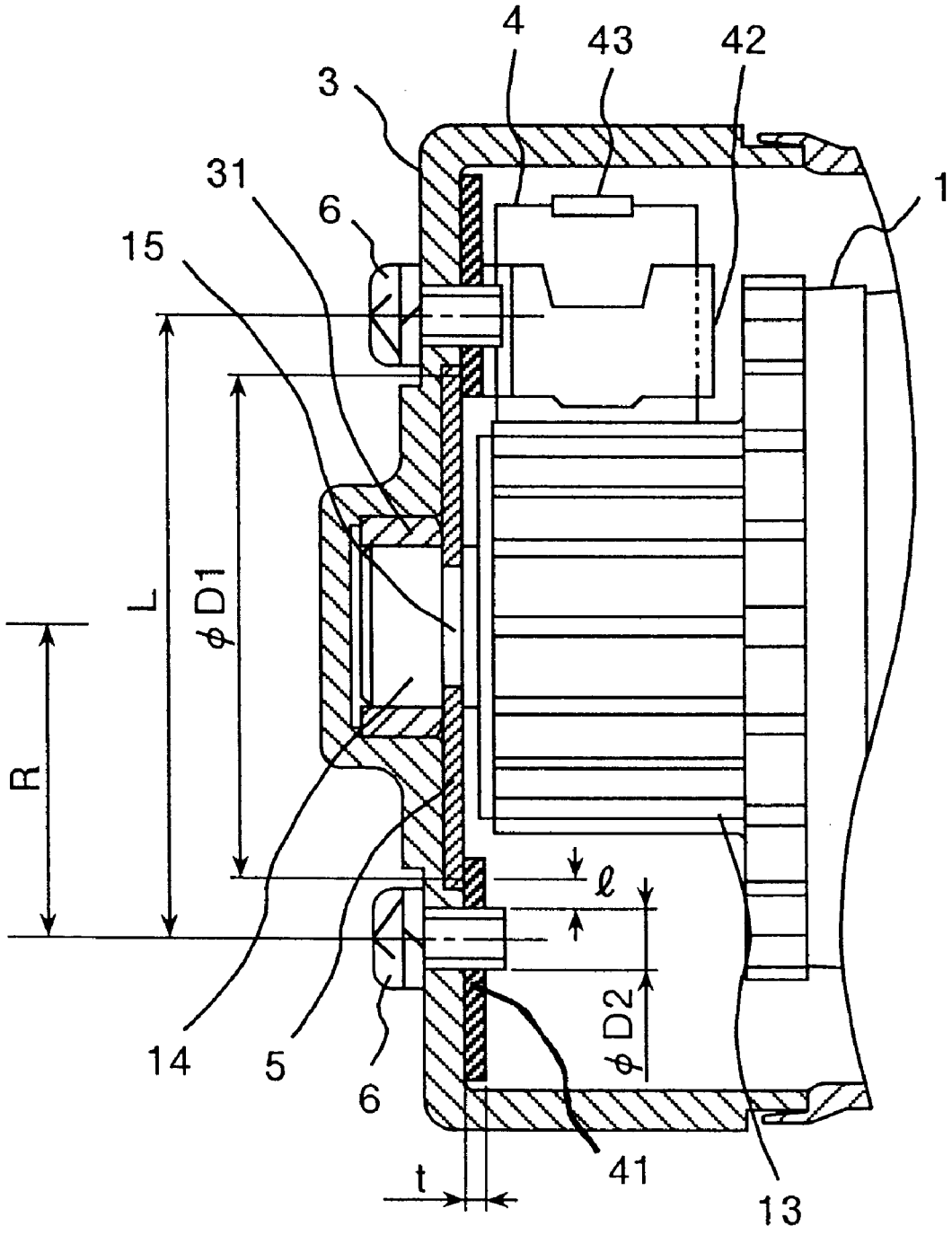
FIG. 1 is a cross-sectional view partly showing an essential portion of one preferred embodiment in accordance of the present invention.

The present preferred embodiment is a preferred embodiment relating to a starter for an automobile. FIG. 1 is a cross-sectional view partly showing an essential portion of one preferred embodiment in accordance of the present invention and FIG. 2 is a partially cutaway view of the general constitution of the preferred embodiment.

First, the general constitution of the starter to which the present invention is applied will be described with reference to FIG. 2.

Figure 2:
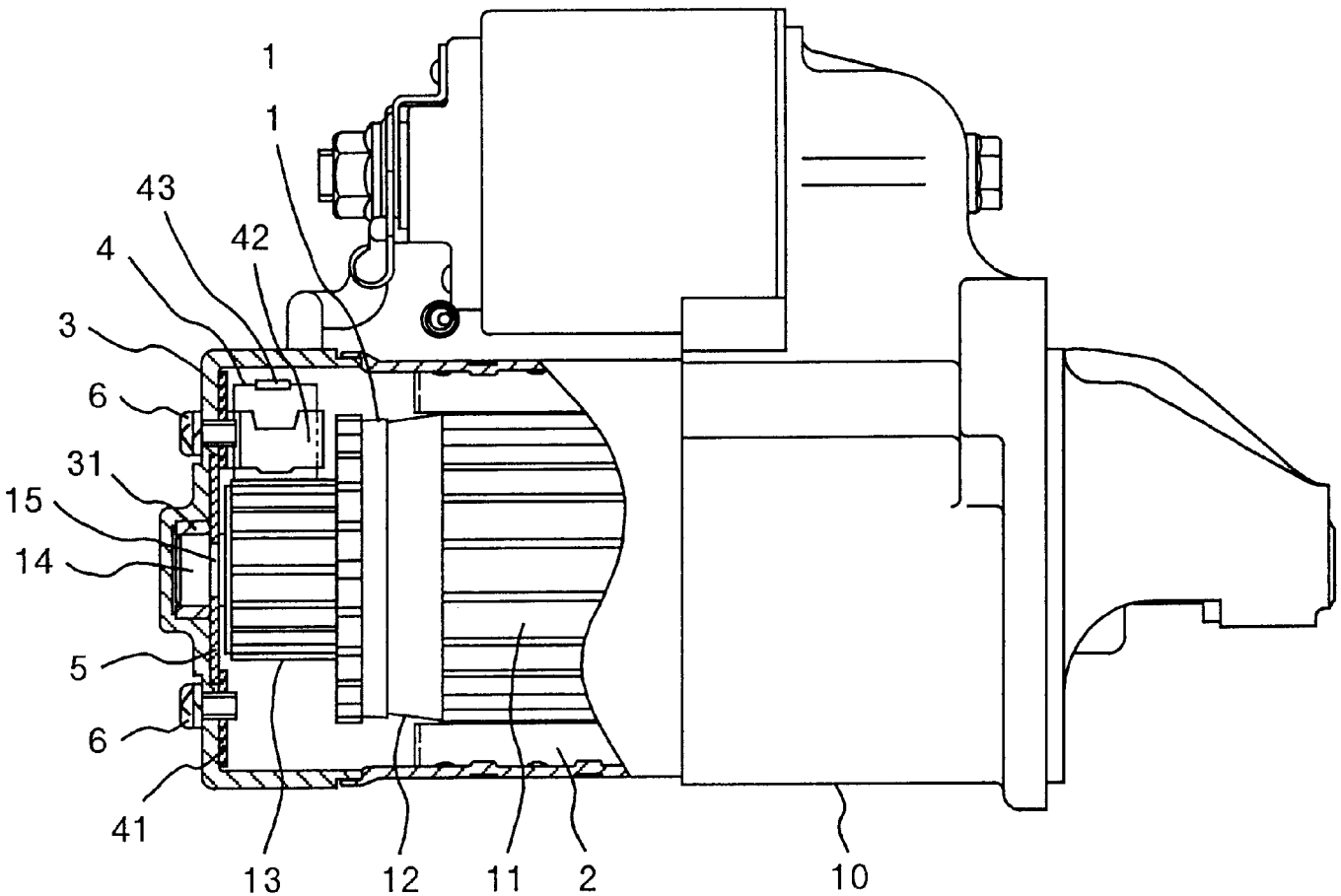
FIG. 2 is a partially cutaway view of the general constitution of the preferred embodiment.

In FIG. 2, the motor part (direct current motor) of a starter 10 is provided with an armature (revolving armature) 1 and field poles (stator) 2.

The armature 1 is provided with an iron core 11, a plurality of coils 12 provided at the outer peripheral portion of the iron core 11, commutators 13 connected to the coils 12, and a shaft 14 to which the iron core 11 and the commutators 13 are fixed.

The field poles 2 are arranged at the positions opposite to the outer periphery of the armature 1 of a motor housing.

A reference numeral 3 designates the end bracket of the motor and the bracket 3 is provided with a bearing 31 for rotatably supporting the shaft 14.

A brush 4 is pressed onto and put in contact with the outer peripheral surfaces of the commutators 13 by a spring 43. The brush 4 is held by a brush holder 42 fixed to the holder plate 41. The holder plate 41 is fixed to the inside of the end surface of the bracket 3 by screws 6.

The shaft 14 of the armature 1 has a groove 15 made in the circumferential direction near the end portion of the bracket 3 side.

As shown in FIG. 1, the inner peripheral portion of a washer 5 is fitted in the annular groove 15 and the outer peripheral portion of the washer 5 is sandwiched by the bracket 3 and the holder plate 41. The washer 5 limits the movement of the shaft 14 in the axial direction.

Figure 4:
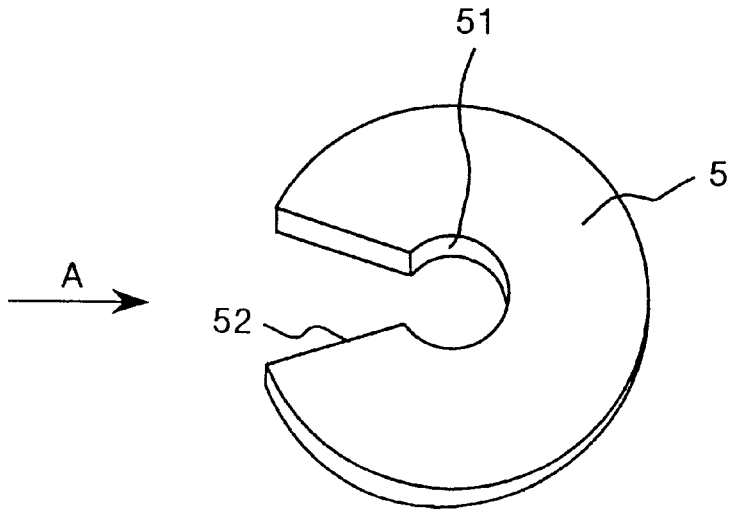
FIG. 4 is a perspective view of a washer applied to the preferred embodiment.
Figure 5:
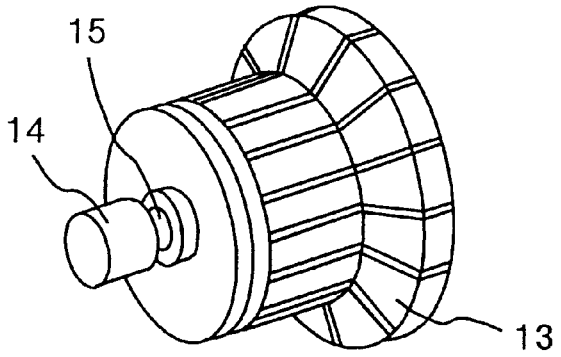
FIG. 5 is a perspective view showing a part of the armature employed in the preferred embodiment.

The washer 5 is a steel plate shaped like a disc with a notch 52, as shown in FIG. 4, the notch 52 having an inner circular portion 51, whose diameter is larger than the outer diameter of the bottom portion of the groove 15 made in the circumferential direction of the shaft 14, and widening in the radial direction. FIG. 5 is a perspective view showing one end portion of the shaft 14 and the width of the annular groove 15 is larger than the thickness of the washer 5.

The washer 5 is put into the circumferential groove 15 made in the shaft 14 of the armature 1, via the notch 52 of the washer 5, from the direction shown by an arrow A, as shown in FIG. 4, in such a way that the shaft 14 can freely rotate.

Since the inner diameter of the washer 5 is larger than the outer diameter of the bottom portion of the circumferential groove 15, the shaft 14 can freely rotate even after the washer 5 is fixed.

The relationship among the holder plate 41, the screws 6, the washer 5, and the shaft 14 will be described with reference to FIG. 1.

In the present preferred embodiment, the number of the screws 6 is two and the screws 6 are spaced 180 degrees apart. Therefore, a line (pitch) connecting both the screws 6 passes the center of the motor (the center of the armature). Letting the pitch of the screw=L, the outer diameter of the washer 5=D1, the outer diameter of the screw 6=D2, and the thickness of the holder plate 41=t, they satisfy the following condition:

$$D1+D2<L\leqq D1+D2+5t \qquad \text{(Formula 9)}$$

The above Formula 9 (Formula 1, Formula 5) means that the distance 1 between the outer peripheral portion of the washer 5 and the screw 6 is not more than 2.5t ($0<1\leqq 2.5t$) (see FIG. 1) and, for example, in the case where the thickness t of the holder plate 41 is 1.2 mm, the distance $1\leqq 3$ mm.

In this way, in the case where the screws 6 are positioned near the outer peripheral portion of the washer 5 in such a way that the distance 1 satisfies the relationship of $0<1\leqq 2.5t$, they can prevent the holder plate 41 from being deflected in the axial direction when a load is applied to the armature 1 in the direction of thrust. This, therefore, improves the rigidity of the washer 5 holding the armature 1 and reduces the vibrations of the armature 1 in the direction of thrust during the rotation of the armature 1, which can reduce noises of the starter 10.

Figure 3:
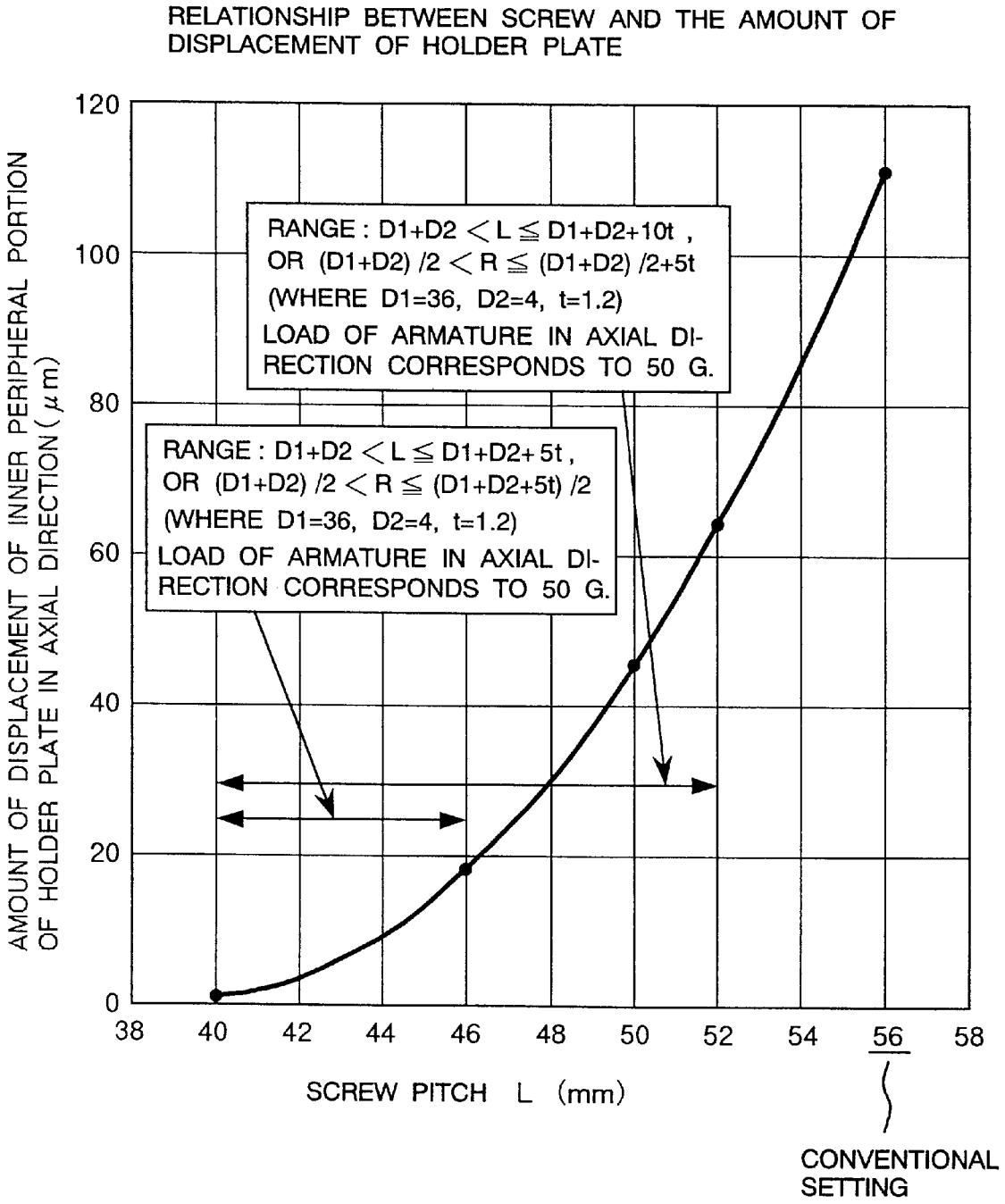
FIG. 3 is a diagram showing a relationship between a pitch L of a screw for fixing a holder plate and the amount of displacement (deflection) δ of the holder plate when a load corresponding to 50 G in an axial direction is applied to an armature employed in the preferred embodiment.

FIG. 3 is a diagram showing a relationship between the pitch L of the screw and the amount of displacement (deflection) δ when an axial load corresponding to 50 G is applied to the armature 1.

The experimental values shown in FIG. 3 were obtained when the outer diameter D1 of the washer 5=36 mm, the outer diameter D2 of the screw 6=4 mm, and the thickness t of the holder plate 41=1.2 mm.

The pitch L satisfying the condition of the above-mentioned Formula 9 ranges from 40 mm to 46 mm and the amount of displacement δ of the inner peripheral portion of the holder plate 41 in the axial direction could be reduced to a range from 0.9 μm to 18.3 μm.

In this connection, the pitch L of the above-mentioned publicly known technology is not less than 56 mm (this is expressed by an equation of L≈D1+D2+13t) and, in this case, the amount of displacement δ of the inner peripheral portion of the holder plate 41 in the axial direction was 110.8 μm. In the present preferred embodiment, the amount of displacement δ was reduced to about ⅙. Therefore, even if the number of the screws for fixing the holder plate 41 is reduced as small as possible, it is possible to dramatically improve the rigidity of the washer 5 holding the armature 1 in comparison with the publicly known technology and to greatly reduce the vibrations of the armature 1 in the direction of thrust during the rotation of the armature 1 and to reduce noises of the starter 10.

In this respect, in the above preferred embodiment, the number of the screws 6 is two and hence the distance 1 from the outer peripheral portion of the washer 5 to the screw 6 is expressed by the above Formula 9 (Formula 1, Formula 5), but the number of the screws 6 may be three or more and, in this case, a formula equivalent to the Formula 9 is expressed by the following formula:

$$(D1+D2)/2<R\leqq(D1+D2+5t)/2 \qquad \text{(Formula 10)}$$

where R means a distance between the center of the shaft 14 of the armature 1 (the center of the motor) and the center of the screw 6. The Formula 10 (Formula 3, Formula 7) can be applied to a case where two screws are used.

In this connection, if the parts of the starter satisfy the above Formula 9 and the Formula 10 relating to their dimensions, they can dramatically reduce the noises of the starter, and it has been found that even if the conditions of the Formulas 9 and 10 are relaxed, the parts satisfying the following Formula 11 or Formula 12 can reduce the amount of displacement δ to about half of that obtained by the publicly known technology and can very effectively reduce the vibrations and noises of the starter 10:

$$D1+D2<L\leqq D1+D2+10t \quad \text{(Formula 11)}$$

$$(D1+D2)/2<R\leqq(D1+D2)/2+5t \quad \text{(Formula 12)}$$

where L=the pitch, D1=the outer diameter of the washer 5, D2=the outer diameter of the screw 6, and t=the thickness of the holder plate 41, and the Formula 12 is equivalent to the Formula 11.

In the case of the above Formula 11 (Formula 2, Formula 6) and the above Formula 12 (Formula 4, Formula 8), the upper limit of the pitch L of the screw 6 corresponds to 52 mm in the diagram shown in FIG. 3 and the amount of displacement δ of the inner peripheral portion of the holder plate 41 in the axial direction is 64 μm, which is greatly reduced as compared with the amount of displacement δ of 110.8 μm produced by the publicly known technology.

In this connection, while the starter for an automobile has been described in the preferred embodiment, it is not intended to limit the present invention to the starter for the automobile, but the present invention can be applied to the starter for an internal combustion engine having the similar structure and can produce the similar effects.

As described above, according to the present invention, it is possible to reduce noises when a starter is put in motion with a simple modification to its structure without increasing the number of parts.

What is claimed is:

1. A starter comprising an armature provided with a shaft having a groove made in a circumferential direction near its one end, a bracket provided with a bearing rotatably supporting the one end of the shaft, a holder plate for holding the brush of a motor, screws for fixing the holder plate to the inside of the end surface of the bracket, and a washer having an inner peripheral portion fitted in the groove made in the circumferential direction of the shaft and an outer peripheral portion sandwiched between the bracket and the holder plate, the washer limiting the movement of the armature in the axial direction, wherein, letting the pitch of the screws=L when the screws for fixing the holder plate to the bracket are spaced 180 degrees apart, the outer diameter of the washer=D1, the outer diameter of the screw=D2, and the thickness of the holder plate=t, they satisfy the following Formula 1, $$D1+D2<L\leqq D1+D2+5t \quad \text{(Formula 1).}$$

2. A starter comprising an armature provided with a shaft having a groove made in a circumferential direction near its one end, a bracket provided with a bearing rotatably supporting the one end of the shaft, a holder plate for holding the brush of a motor, screws for fixing the holder plate to the inside of the end surface of the bracket, and a washer having an inner peripheral portion fitted in the groove made in the circumferential direction of the shaft and an outer peripheral portion sandwiched between the bracket and the holder plate, the washer limiting the movement of the armature in the axial direction, wherein, letting the pitch of the screws=L when the screws for fixing the holder plate to the bracket are spaced 180 degrees apart, the outer diameter of the washer=D1, the outer diameter of the screw=D2, and the thickness of the holder plate=t, they satisfy the following Formula 2, $$D1+D2<L\leqq D1+D2+10t \quad \text{(Formula 2).}$$

3. A starter comprising an armature provided with a shaft having a groove made in a circumferential direction near its one end, a bracket provided with a bearing rotatably supporting the one end of the shaft, a holder plate for holding the brush of a motor, screws for fixing the holder plate to the inside of the end surface of the bracket, and a washer having an inner peripheral portion fitted in the groove made in the circumferential direction of the shaft and an outer peripheral portion sandwiched between the bracket and the holder plate, the washer limiting the movement of the armature in the axial direction, wherein, letting the distance between the center of the shaft of the armature and the center of the screws=R, the outer diameter of the washer=D1, the outer diameter of the screw=D2, and the thickness of the holder plate=t, they satisfy the following Formula 3, $$(D1+D2)/2<R\leqq(D1+D2+5t)/2 \quad \text{(Formula 3).}$$

4. A starter comprising an armature provided with a shaft having a groove made in a circumferential direction near its one end, a bracket provided with a bearing rotatably supporting the one end of the shaft, a holder plate for holding the brush of a motor, screws for fixing the holder plate to the inside of the end surface of the bracket, and a washer having an inner peripheral portion fitted in the groove made in the circumferential direction of the shaft and an outer peripheral portion sandwiched between the bracket and the holder plate, the washer limiting the movement of the armature in the axial direction, wherein, letting the distance between the center of the shaft of the armature and the center of the screws=R, the outer diameter of the washer=D1, the outer diameter of the screw=D2, and the thickness of the holder plate=t, they satisfy the following Formula 4, $$(D1+D2)/2<R\leqq(D1+D2)/2+5t \quad \text{(Formula 4).}$$

* * * * *